United States Patent [19]

Saitou

[11] Patent Number: 4,687,358

[45] Date of Patent: Aug. 18, 1987

[54] TRANSFER MATERIAL HOLDING CASSETTE INCLUDING CORE ROTATION INHIBITING MEANS

[75] Inventor: Masao Saitou, Kamakura, Japan

[73] Assignee: Kabushiki Kaisha Toshiba, Kawasaki, Japan

[21] Appl. No.: 733,927

[22] Filed: May 14, 1985

[30] Foreign Application Priority Data

May 15, 1984 [JP] Japan ..... 59-99476

[51] Int. Cl.[4] ..... B41J 32/00

[52] U.S. Cl. ..... 400/208; 400/120; 400/234; 400/240.3; 242/189; 242/198; 206/387

[58] Field of Search ..... 206/387; 242/55.19 A, 242/189, 198; 400/120, 207, 208, 208.1, 234, 240.3

[56] References Cited

U.S. PATENT DOCUMENTS

| | | | |
|---|---|---|---|
| 2,972,402 | 2/1961 | Howard | 400/234 X |
| 3,774,538 | 11/1973 | Bullock | 400/208 X |
| 3,887,943 | 6/1975 | Katsurayama | 242/189 X |
| 4,074,799 | 2/1978 | Hishida et al. | 400/234 X |
| 4,079,827 | 3/1978 | Work | 400/234 |
| 4,212,551 | 7/1980 | Marsico | 400/208 |
| 4,373,824 | 2/1983 | Olsen | 400/208 X |
| 4,378,566 | 3/1983 | Tsukamura | 400/234 X |
| 4,472,753 | 9/1984 | Wulfing | 242/55.19 A |
| 4,511,271 | 4/1985 | Oberto | 400/208 |
| 4,534,666 | 8/1985 | Watanabe | 400/120 X |

FOREIGN PATENT DOCUMENTS

| | | | |
|---|---|---|---|
| 0131075 | 8/1983 | Japan | 400/240.3 |
| 399767 | 3/1966 | Switzerland | 242/55.19 A |

OTHER PUBLICATIONS

IBM Technical Disclosure Bulletin, "Cartridge Reel Brake", Rinkleib, vol. 27, No. 1B, Jun. 1984, p. 740.

*Primary Examiner*—Ernest T. Wright, Jr.
*Attorney, Agent, or Firm*—Schwartz, Jeffery, Schwaab, Mack, Blumenthal & Evans

[57] ABSTRACT

An improved transfer material holding cassette is provided with a rotation inhibiting means which serves to inhibit the core from being rotated freely at a time before it is fitted to the housing of an image building apparatus in which an image is built using the transfer material and release it from the rotation inhibited state when it is fitted to the housing. The rotation inhibiting means is located opposite to the plane of a core extending at a right angle relative to the axis of rotation of the core and comprises a lever turnably supported on the inner wall of the case to turn about the middle part thereof, the one end of the lever being located opposite to the plane of the core and the other end of the same being located opposite to an opening on the case, and a resilient member adapted to normally turn the lever in such a direction that the one end of the lever comes in contact with the core under the effect of a resilient force so as to inhibit the core from being rotated freely. When the cassette is fitted to the housing of the apparatus, the resilient member is kept free from the rotation inhibited state by turning the lever in the opposite direction by means of a pin which is inserted into the opening located opposite to the other end of the lever.

14 Claims, 24 Drawing Figures

TRANSFER MATERIAL HOLDING CASSETTE INCLUDING CORE ROTATION INHIBITING MEANS

BACKGROUND OF THE INVENTION

1. Field of the Invention

The present invention relates to a transfer material holding cassette and more particularly to improvement of or relating to a transfer material holding cassette of the type including a transfer material of which one surface is coated with a properly selected coloring agent, two cores for reciprocably displacing the transfer material in such a manner as to wind the latter about the one core and unwind it from the other one and a case for housing therein the transfer material and both the cores.

2. Description of the Related Art

As is well known, a transfer material holding cassette of the above-mentioned type is used for an image building apparatus in which an image is built by transferring coloring agent on the transfer material onto a material to be image transferred. This type of transfer material holding cassette is generally constructed such that a pair of cores with transfer material wound thereabout are rotatably supported in a case adapted to be detachably fitted to the image building apparatus while a part of the transfer material located between both the cores is exposed to the outside. When it is fitted to the image building apparatus, rotational power is transmitted from the latter to the cores so that the transfer material is unwound from the one core while it is wound about the other one.

Once the transfer material holding cassette is fitted to the image building apparatus, both the cores are mechanically connected to a rotational power source in the apparatus, and transfer material is properly displaced by the rotational power transmitted from the rotational power source without the occurrence of a malfunction such as loosening or the like. However, a problem inherent to the conventional transfer material holding cassette is that loosening, slackening or the like tends to take place with the transfer material before the cassette is fitted to the apparatus, because both of the cores are free to rotate. The fact that there is a tendency of causing malfunction such as loosening, slackening or the like before fitting of the transfer material holding cassette to the apparatus means that there is a danger of damaging or injuring the transfer material when the cassette is fitted to the apparatus or during operation of the same.

SUMMARY OF THE INVENTION

Thus, the present invention has been made with the foregoing problem in mind and its object resides in providing an improved transfer material holding apparatus of the early mentioned type which assures that undesirable loosening, slackening or the like does not take place with transfer material under any operative condition.

To accomplish the above object there is proposed according to the present invention a transfer material holding cassette of the type including a transfer material in the form of a ribbon or tape. One surface of the transfer material is coated with a properly selected coloring agent. The cassette further comprises first and second cores for reciprocably displacing the transfer material. A first core is adapted to wind the transfer material around itself and the other core is adapted to unwind the material to be wound on the first core. A case for housing the transfer material and both the first and second cores provided. The case is detachably fitted to a housing of the image building apparatus together with the transfer material and the cores. A required image is built by transferring coloring agent on the transfer material onto a material to be image transferred. The improvement comprises a rotation inhibiting means disposed at a predetermined position corresponding to the first or second core, the rotation inhibiting means serving to inhibit the latter from being rotated freely at a time before the transfer material holding cassette is fitted to the housing of the image building apparatus. The rotation inhibiting means automatically releases it from the inhibited state when it is fitted thereto.

Typically the rotation inhibiting means is constructed as a lever (stop lever) or brake lever turnably supported on the inner wall of the case extending at a right angle relative to the axis of the core to turn about the middle part thereof. One end of the lever (stop lever) or brake lever is located opposite to a plane extending at a right angle relative to the axis of the core and the other end of the same is located opposite an opening (release hole) formed on the case. A resilient member is adapted to normally turn the lever in such a direction that the one end of the lever comes in contact with the plane of the core under the effect of resilient force so as to inhibit the core from being rotated freely. The resilient member is released from the rotation inhibited state by turning the lever in the opposite direction by means of a pin which is inserted into the opening (release hole) located opposite to the other end of the lever.

Other objects, features and advantages of the invention will become more clearly apparent from reading of the following description which has been made in conjunction with the accompanying drawings.

BRIEF DESCRIPTION OF THE DRAWINGS

The accompanying drawings will be briefly described below.

DESCRIPTION OF THE PREFERRED EMBODIMENTS

Now, the present invention will be described in a greater detail hereunder with reference to the accompanying drawings which illustrate preferred embodiments thereof.

First, description will be made below as to an image building apparatus with a transfer material holding cassette of the invention incorporated therein with reference to FIGS. 1 to 3 which schematically illustrate the whole structure of the apparatus.

Figure 1:
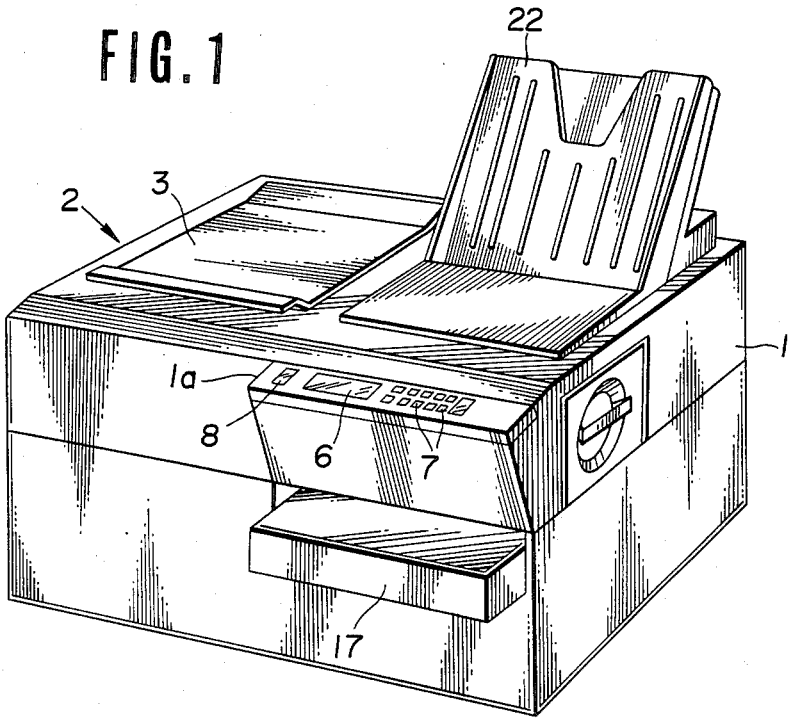
FIG. 1 is a perspective view of an image building apparatus with a transfer material holding cassette according to the invention incorporated thereof.

FIG. 1 is a perspective view of the image building apparatus, particularly illustrating the appearance thereof. FIG. 2 is a partially exploded perspective view of the apparatus, particularly illustrating how the whole apparatus is constructed. FIG. 3 is a vertical sectional view of the apparatus. In the drawing, reference numeral 1 designates a housing of the apparatus. The housing 1 is provided with a control board 1*a* on the upper front wall of the apparatus. Further, the apparatus includes an original platform 2 on the upper surface of the housing 1 in the lefthand area of the latter as seen in the drawing and a cover 3 is placed on the original platform 2. An original scanning section (scanner) 4 adapted to scan an original set on the original platform 2 is disposed at the position located below the original platform 2 in the housing 1 and the righthand side of the housing 1 constitutes an image building section (printer) 5.

Figure 2:
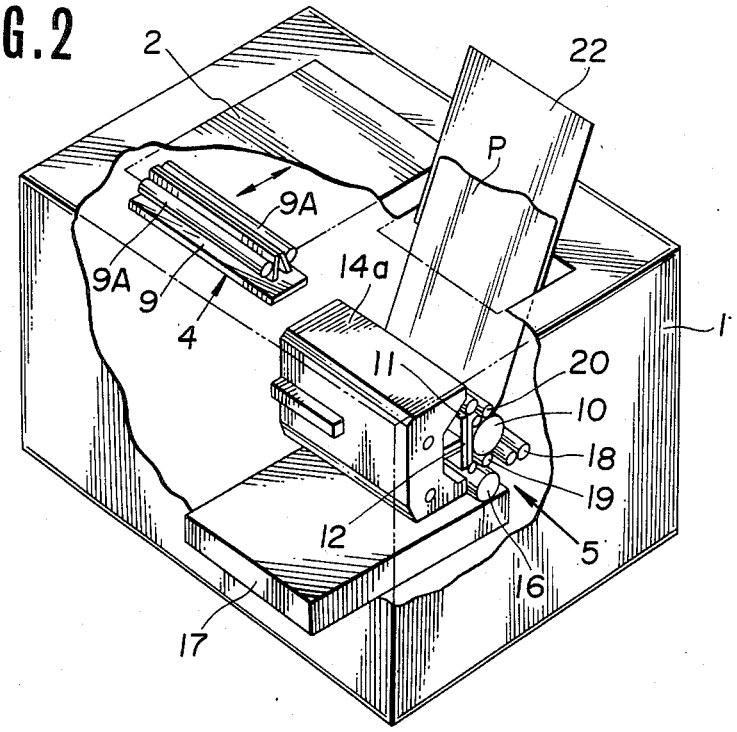
FIG. 2 is a partially exploded perspective view of the image building apparatus in FIG. 1, particularly illustrating how essential components are arranged in the apparatus.

As illustrated in FIG. 2, the original scanning section 4 is so constructed that a movable scanning portion 9 disposed in the optical exposure system moves in parallel with the lower surface of the original platform 2 to optically scan the original. The optical information is photoelectrically converted into electrical signals which are inputted into the image building section 5.

Figure 3:
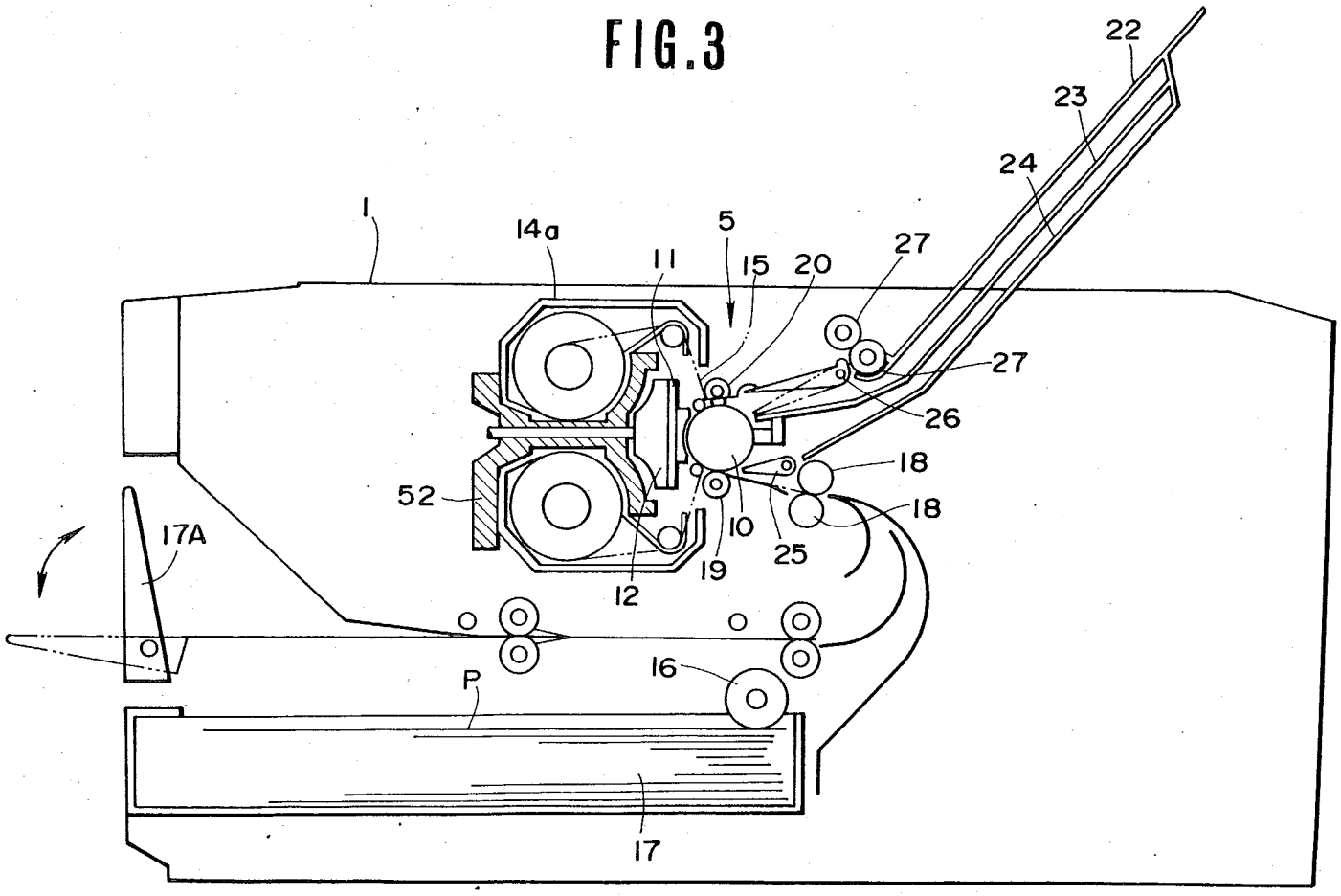
FIG. 3 is a side view partially in section of the image building apparatus of FIG. 1.

The image building section 5 is constructed as illustrated in FIGS. 2 and 3. Namely, a platen 10 is disposed at the position located substantially in the middle of the image building section 5, and a thermal head 11 serving as a recording head is disposed in front of the platen 10 (leftwardly of the latter as seen in FIG. 3) so as to move toward the platen 10 and away from the same.

The thermal head 11 is attached to a holder 12 with a heat radiating board interposed therebetween. Further, the apparatus includes a thermal transfer ribbon cassette (hereinafter referred to simply as ribbon cassette) 14*a* serving as a transfer material holding cassette which is supported in the image building section 5 with the aid of a bracket 52. A thermal transfer ribbon 15 serving as transfer material is extended through the space as defined between the thermal head 11 and the platen 10.

A paper feeding roller 16 is disposed at the position located below the platen 10 so that papers P serving as material to be image transferred which are received in a paper feeding cassette 17 are taken out therefrom one by one. A paper P thus taken out from the paper feeding cassette 17 is brought to a pair of rollers 18 which are located above the paper feeding roller 16 so that the foremost end of the paper P is correctly oriented. Thereafter, it is displaced toward the platen 10 and it is then held on the platen 10 in the partially wound state with the aid of thrust rollers 19 and 20. Thus, as the platen roller 10 is rotated, the paper P is correctly displaced further without any occurrence of slippage. It should be added that the apparatus is provided with a manual paper feeding guide 17A on the front side of the housing 1 at the position located above the left end of the paper feeding cassette 17 in order that a paper P can be manually fed into the apparatus therethrough.

Figure 4:
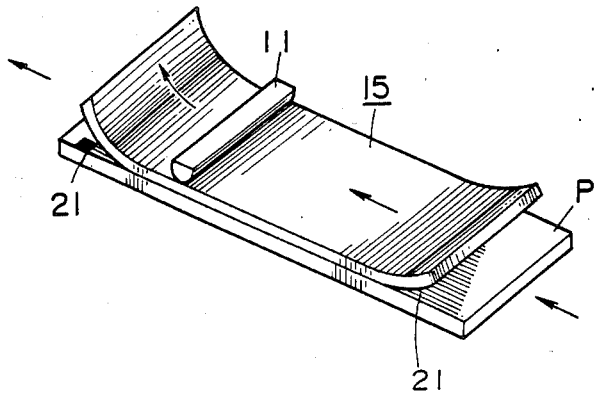
FIG. 4 is a schematic perspective view illustrating how the transfer material is used in cooperation with a material to be image transferred.

On the other hand, the thermal head 11 is adapted to thrust paper P against the platen 10 with the thermal transfer ribbon 15 serving as thermal transfer material interposed therebetween. Thus, as illustrated in FIG. 4, ink 21 serving as coloring agent on the thermal transfer ribbon 15 is molten under the influence of an elevated temperature of the thermal head 11 and molten ink 21 is then transferred onto the paper P.

Next, description will be made below as to the thermal transfer ribbon 15.

Figure 5:
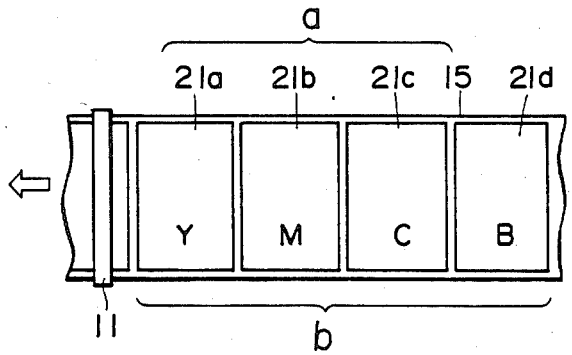
FIG. 5 is a fragmental plan view of a thermal transfer ink ribbon serving as transfer material, particularly illustrating how a plurality of ink sections are arranged one after another on the thermal transfer ink ribbon.

As illustrated in FIG. 5, the thermal transfer ribbon 15 has the substantially the same width as that of paper P and includes three ink sections 21*a*, 21*b* and 21*c* arranged one after another in the longitudinal direction. In the illustrated embodiment a color of yellow (Y) is allocated to the ink section 21*a*, a color of magenta (M) is allocated to the ink section 21*b* and a color of cyan (C) is allocated to the ink section 21*c* in the area a on the layer of suitable film which constitutes a main body of the thermal transfer ribbon 15. Alternatively, it may include four ink sections 21*a*, 21*b*, 21*c* and 21*d* arranged one after another in the longitudinal direction in the area b on the layer of film. In this case a color of yellow (Y) is allocated to the ink section 21*a*, a color of magenta (M) is allocated to the ink section 21*b*, a color of cyan (C) is allocated to the ink section 21*c* and a color of black (B) is allocated to the ink section 21*d*. The image building section 5 is operated such that at every time when each of the colors as mentioned above is transferred onto paper P, the latter is restored to the initial position and by repeating the above-mentioned steps the required number of colors are successively superimposed one above another.

The thermal transfer ribbon 15 with the black ink section 21*d* included therein is put in use when there is a requirement for clearly exhibiting a color of black. However, it is found that a color very close to real black can be exhibited by superimposing three colors comprising yellow, magenta and cyan one above another without necessity for the black ink section 21*d*.

By rotating the platen 10 the paper P is reciprocably displaced at the same times as the number of colors in the above-described manner. While it is reciprocably displaced in that way, it is brought onto first and second guides 23 and 24 which are disposed in the inclined posture below the paper discharge tray 22.

Next, reciprocable movement of the paper P will be described below with reference to FIGS. 6A to 6D.

Figure 6A:
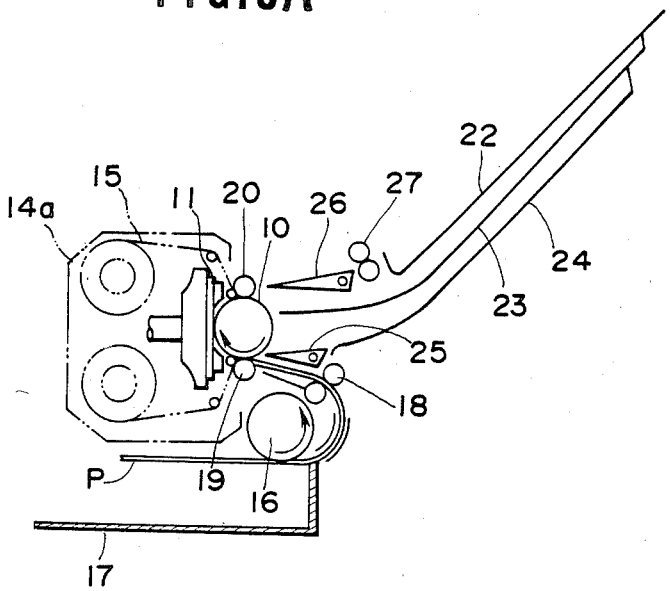
FIGS. 6A, 6B, 6C, and 6D fragmental vertical sectional views of the image building apparatusrespectively, particularly illustrating how paper is reciprocably displaced during multicolor transference.

After a paper P is taken out from the paper feeding cassette 17, it is delivered to the platen 10 via the pair of rollers 18 and the first distributing guide 25 which has assumed the illustrated position and it is then partially wound about the platen 10 (see FIG. 6A).

When the platen 10 is rotated by means of a pulse motor serving as rotational power source which is per se well known and thus not shown in the drawings, the paper P is displaced at a predetermined speed. At this moment a number of heating elements (not shown) disposed on the thermal head 11 in the line-dot arrangement in the axial direction of the platen 10 are heated up in response to transmitted image information whereby ink 21 on the thermal transfer ribbon 15 is transferred onto the paper P.

Figure 6B:
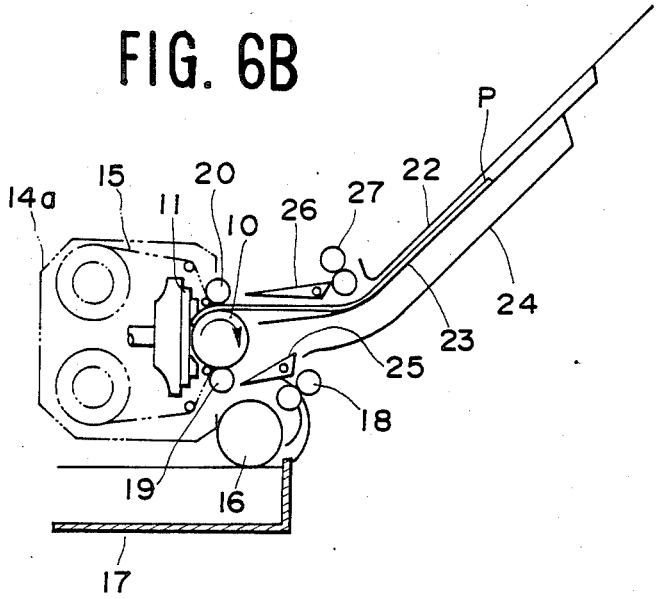

After the fore end of the paper P leaves the platen 10, it is brought onto the first guide 23 extending in parallel with the paper discharge tray 22 in the area located below the latter via the second distributing guide 26 which has assumed the illustrated position (see FIG. 6B).

Figure 6C:
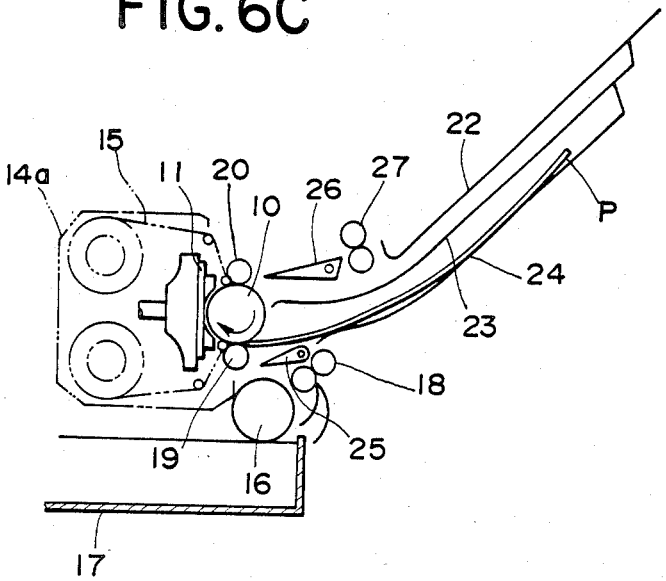

The paper P with ink 21 having a certain color transferred thereto is then displaced reversely as the platen 10 is rotated in the reverse direction, until it is brought onto the second guide 24 extending in parallel with the first guide 23 in the area located below the latter via the first distributing guide 25 which has been turned to the illustrated position in the anticlockwise direction (see FIG. 6C).

Thus, by reciprocably displacing the paper P in the above-described manner the same number of times as the number of colors, transference of plural colors is achieved.

Figure 6D:
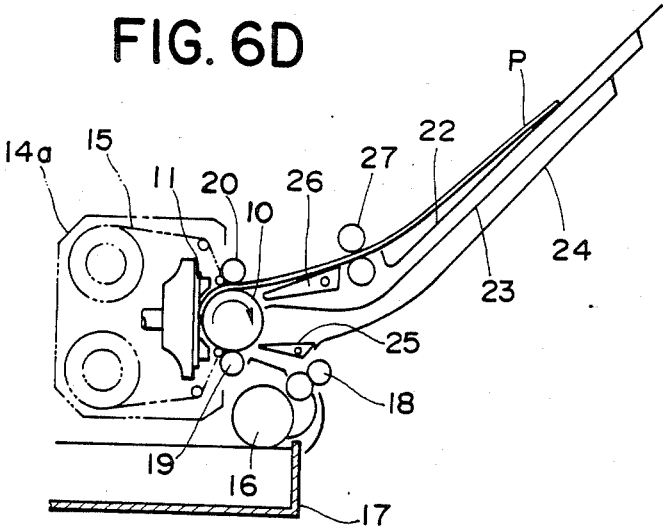

Finally, after the desired kinds of color inks 21 are transferred onto the paper P, it is discharged onto the paper discharge tray 22 via the second distributing guide 26 which has been turned to the illustrated position in the counterclockwise direction as a pair of paper discharge rollers 27 are rotated (see FIG. 6D).

Figure 7:
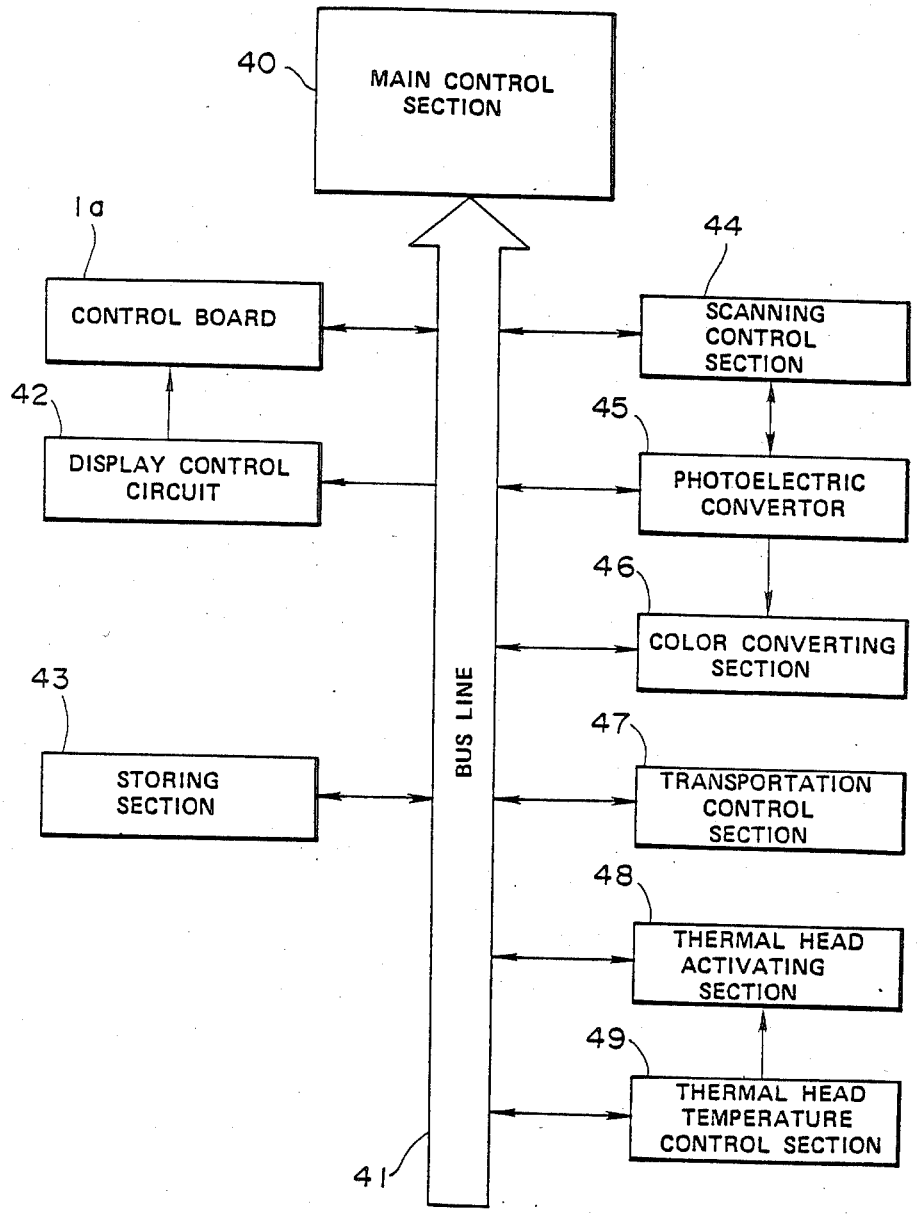
FIG. 7 is a block diagram illustrating a control system for the whole apparatus.

FIG. 7 is a block diagram which schematically illustrates a control system for the whole apparatus. Namely, in the drawing reference numeral 40 designates a main control section which serves to control operations of the whole apparatus. The main control section 40 is generally constructed by a combination of a central processing unit and associated components, and a bus line 41 is connected to the main control section 40. Further, control board 1*a*, display control circuit 42, storing section 43, scanning control section 44, photoelectric converting section 45, color converting section 46, transportation control section 47, thermal head activating section 48 and thermal head temperature control section 49 are connected to the bus line 41 respectively.

Specifically, the display control circuit 42 is activated in response to signals transmitted from the main control section 40 via the bus line 41 so as to control operation of the display section 6 on the control board 1*a*. The storing section 43 is activated in response to signals transmitted from the main control section 40 via the bus line 41 so as to store information transmitted via the bus line 41 or read the thus stored information as required. The scanning control section 44 is activated in response to signals transmitted from the main control section 40 via the bus line 41 so as to control turning-on and -off of the front lamp 9A in the movable scanning section 9 and other operations of the photoelectric converter 45 and the scanning motor which is not shown in the drawings. The photoelectric converter 45 detects an image on an original in response to signals transmitted from the main control section 40 via the bus line 41 and then outputs signals for each of the above-mentioned colors. The color converting section 46 receives signals thus outputted from the photoelectric convertor 45 and processes them to convert them into color signals for each of inks having yellow, magenta, cyan and black colors. These converted color signals are outputted to the bus line 41. Further, the color converting section 46 effects color conversion also in response to signals transmitted from the bus line 41 and then outputs new signals to the bus line 41. The transportation control section 47 is activated in response to signals transmitted from the main control section 40 via the bus line 41 so as to control operation of the motor for driving the platen 10, the motor (not shown) for driving cores 31 and 32 of the ribbon cassette 14*a*, the motors for rotating the rollers 18 and the paper discharge rollers 27 and the solenoids (not shown) for turning the first and second distributing gates 25 and 26 respectively. The thermal head activating section 48 is activated in response to signals transmitted from the main control section 40 via the bus line 41 as well as signals transmitted from the thermal head temperature control section 49 so as to control turning-on and -off of the heating elements on the thermal head 11. Finally, the thermal head temperature control section 49 outputs temperature control signals to the thermal head activating section 48 in response to signals transmitted from the main control section 40 via the bus line 41.

Next, description will be made below as to a ribbon cassette 14*a* in accordance with an embodiment of the invention with reference to FIGS. 8 to 11.

Figure 8:
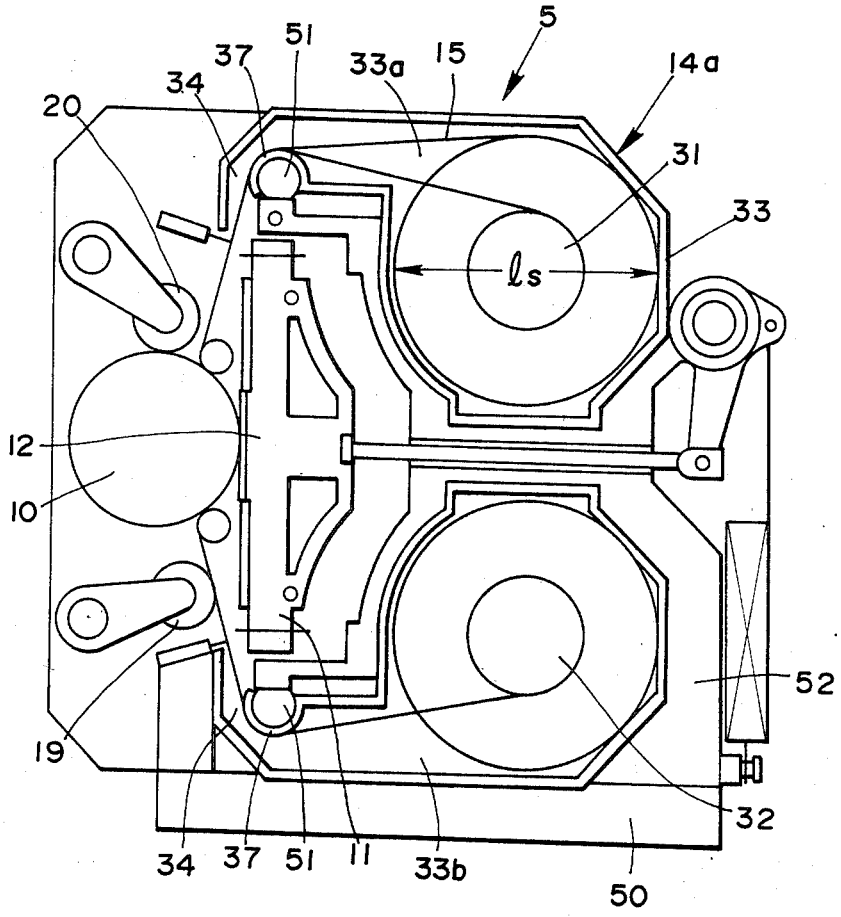
FIG. 8 is a vertical sectional side view of a transfer material holding cassette of the invention, illustrating how it is fitted to the housing of the image building apparatus.

FIG. 8 is a side elevational view of a ribbon cassette 14*a* incorporated in the image building section 5. In the drawing reference numeral 50 designates a printer frame. The printer frame 50 has a bracket 52 fixedly mounted thereon so as to detachably hold a ribbon cassette 14*a* and a pair of cassette support shafts 51 are fixedly secured to the bracket 52 while extending in parallel with the axis of the platen roller 10. The ribbon cassette 14*a* includes two cores 31 and 32 which extend in parallel with one another so that both the ends of the thermal transfer ribbon 15 are anchored at the cores 31 and 32 in such a manner that they are wound about the latter. It should be noted that a part of the thermal transfer ribbon 15 is exposed to the outside in the area as defined between the platen 10 and the thermal head 11 when it is set in the case 33 while both the ends thereof are wound about the cores 31 and 32.

As will be apparent from FIG. 8, the case 33 is formed with an opposing pair of axially extending openings 34 in the core housing portions 33*a* and 33*b* which are oriented toward the cores 31 and 32. Further, the case 33 is integrally formed with a pair of guides 37 having the arch-shaped configuration at the position located in the proximity of the openings 34 so as to guide sliding movement of the thermal transfer ribbon 15 during winding and unwinding of the latter about the cores 31 and 32. A shaft 51 is inserted through each of the semicircular hollow spaces as defined by the inner walls of the guides 37.

Figure 9A:
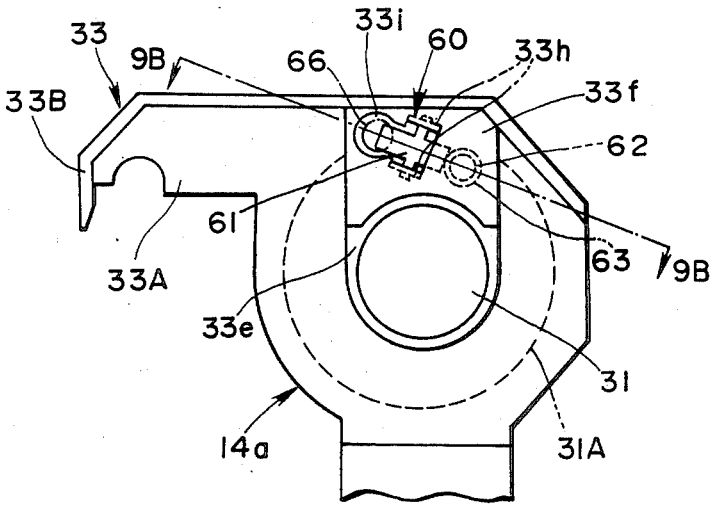
FIG. 9A is a fragmental side view of the cassette in accordance with the first embodiment of the invention.
Figure 9B:
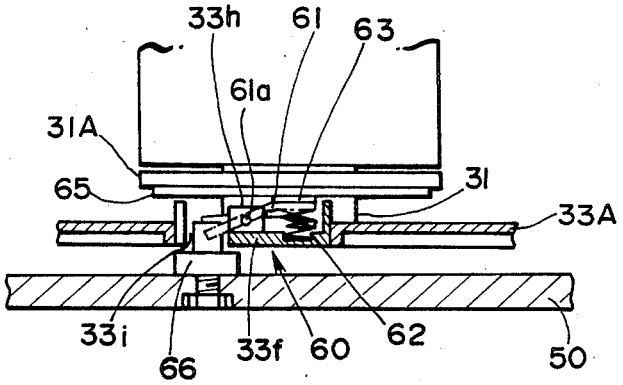
FIG. 9B is a cross-sectional view of the cassette taken on line 9B—9B in FIG. 9A.

FIG. 9A is a fragmental sectional view of the ribbon cassette 14*a* in accordance with the first embodiment of the invention. FIG. 9B is a cross-sectional view of the ribbon cassette 14*a* taken along line 9B—9B in FIG. 9A. The case 33 is constituted by a combination of case body 33A and cover 33B which is detachably secured to the case body 33A. A vertically extending groove 33*e* is formed on the side wall of the case body 33A so as to pivotally support the axial end of the core 31. To this end a holding member 33*f* adapted to rotatably hold the upper part of the axial end of each of the cores 31 and 32 is fitted to the case body 33a as a part of the latter. The holding member 33*f* is provided with a rotation inhibiting mechanism 60 which serves to inhibit free rotation of the core 31 before the ribbon cassette 14*a* is fitted to the image building apparatus. In the illustrated embodiment the rotation inhibiting mechanism 60 is constituted by an opposing pair of support pieces 33*h* extending inwardly of the case 33. A stop lever 61 has a middle part which is supported on a pin 61*a* extending through the support pieces 33*h* to turn thereabout. A resilient member (for instance, a compression coil spring) 62 is interposed between the stop lever 61 and the holding member 33*f* to thrust the one end of the stop lever 61 in the direction away from the case 33 by turning movement of the latter under the effect of resilient force of the resilient member 62. A frictional braking member 63 is adhesively secured to the stop lever 61 and a release hole 33*i* formed in the holding member 33*f* allows the opposite end of the stop lever 61 (relative to the frictional braking member 63) to be exposed to the outside. On the other hand, the core 31 has a flange 31A fixedly mounted thereon at the position located in the proximity of the outer end of the core 31, and a brake pad 65 (adapted to come in surface contact with the frictional braking member 63) is adhesively attached to the side wall of the flange 31A. At a time before the ribbon cassette 14*a* is fitted to the image building apparatus, the frictional braking member 63 adhesively secured to the stop lever 61 is brought into frictional contact with the braking pad 65 whereby the core 31 is inhibited from free rotation. The printer frame 50 has an inwardly projecting pin 66. When the ribbon cassette 14*a* is fitted to the image building apparatus, the pin 66 is inserted into the opening 33*i* and thereby the foremost end of the pin 66 abuts against the other end of the stop lever 61. As a result, the stop lever 61 is turned in the clockwise direction as seen in the drawing against the resilient force of the resilient member 62 so that the frictional braking member 63 is moved away from the brake pad 65. Once the ribbon cassette 14*a* is fitted to the image building apparatus, the core 31 is free to rotate. Incidently, the other core 32 which is not shown in FIGS. 9A and 9B is also provided with a rotation inhibiting mechanism 60 similar to that for the core 31 in the same manner as described above.

Figure 10:
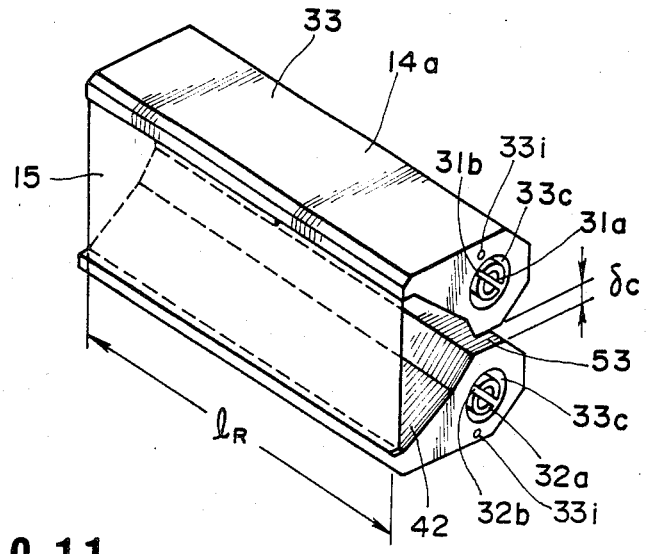
FIG. 10 is a perspective view of the cassette as illustrated in FIGS. 9A and 9B.
Figure 11:
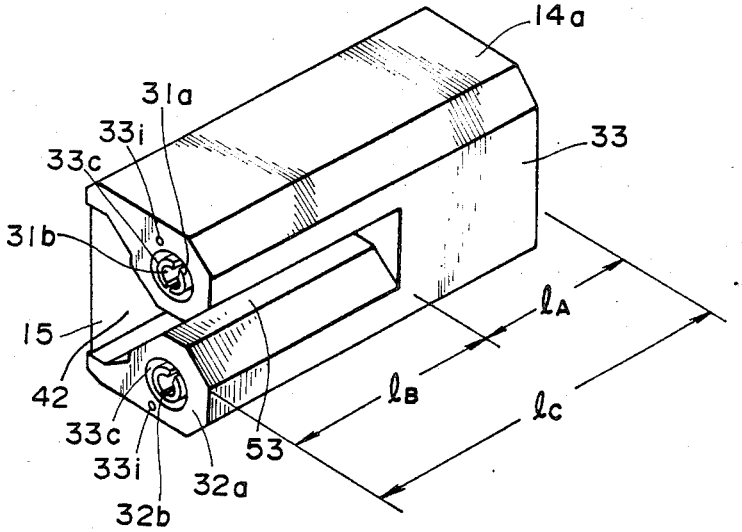
FIG. 11 is another perspective view of the cassette as seen in the different direction from that in FIG. 10.

As illustrated in FIGS. 10 and 11, rotational power receiving end portions 31*a* and 32*a* located in axial alignment with the cores 31 and 32 to be operatively connected to the driving shafts of motors (not shown) through holes 33*c* are arranged on the one side wall of the case 33. As is apparent from the drawings, the rotational power receiving end portions 31*a* and 32*a* are formed with slots 31*b* and 32*b* at one end of the cores 31 and 32. When the ribbon cassette 14*a* is fitted to the casing 1 of the apparatus at the predetermined position, engagement projections serving as couplings on the driving shafts of the motors are engaged in the slots 31*b* and 32*b* so that rotational power is alternately transmitted to the core 31 or 32.

As is apparent from FIGS. 10 and 11, the case 33 of the ribbon cassette 14*a* is designed in a substantially U-shaped cross-sectional configuration, with an open space 42 defined by the exposed part of the thermal transfer ribbon 15 and the inner wall of the case 33 so that the holder 12 and the thermal head 11 are housed in the open space 42. The geometrical configuration of the case 33 will be described in more detail as follows.

The width $l_R$ of the thermal transfer ribbon 15 (see FIG. 10) is larger than the maximum diameter $l_S$ of a ribbon coil wound about the core 31 or 32 (see FIG. 8), and the depth $l_B$ of a slit 53 on the case 33 (see FIG. 11) is larger than a half of the width $l_R$ of the thermal transfer ribbon 15. Thus, an inequality $l_B > (\frac{1}{2})\ l_R$ is established. Thus, the case 33 of the ribbon cassette 14*a* having the total width $l_C$ is constituted by a junction part having the width $l_A$ and two upper and lower parts having the length $l_B$ joined to one another via the junction part with the slit 53 located therebetween.

Fitting of the ribbon cassette 14*a* to the housing 1 of the apparatus is effected by way of the steps of locating the free end of each of the shafts 51 in alignment with the open end of each of the guides 37 and thrusting the ribbon cassette 14*a* forwardly in the longitudinal direction (in the axial direction of the platen 10) while the side face of the bracket 52 is located opposite to the open end of the slit 53. Removal of the ribbon cassette 14*a* from the housing 1 is achieved by way of the steps reverse to those in the case of fitting of the same.

As will be readily understood from the above description, the frictional braking member 63 adhesively attached to the stop lever 61 is brought into frictional engagement with the brake pad 65 on the core 31 at a time before the ribbon cassette 14*a* is fitted to the image building apparatus, resulting in the core 31 being inhibited from free rotation. Thus, an advantageous feature of the ribbon cassette 14*a* of the invention is that there is no fear of causing malfunction such as loosening of thermal transfer material or the like before it is fitted to the image building apparatus. Another advantageous feature of the invention is that transference is effected without encountering any hindrance when it is fitted to the image building apparatus, because the frictional braking member 63 is moved away from the brake pad 65 immediately after completion of the fitting operation.

Next, description will be made below as to a ribbon cassette 14*a* in accordance with the second embodiment of the invention with reference to FIG. 12.

Figure 12:
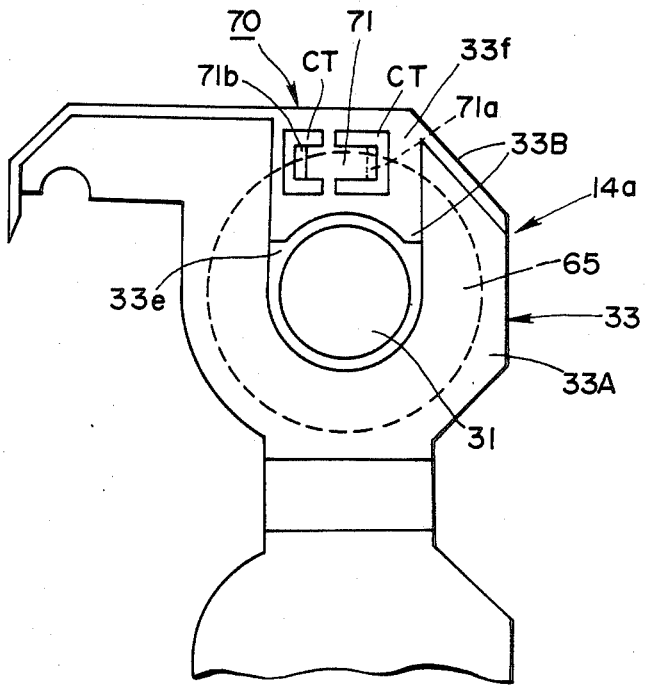
FIG. 12 is a fragmental side view of the cassette in accordance with the second embodiment of the invention.

FIG. 12 is a fragmental side view of the ribbon cassette 14*a* in accordance with the second embodiment. The same or similar parts and components in FIG. 12 as those in the first embodiment are identified by the same reference numerals and their repeated description is eliminated for the purpose of simplification. In this embodiment the rotation inhibiting mechanism 70 is constructed in a different manner from the structure described in the foregoing embodiment. Namely, instead of a combination of the stop lever 61 and the resilient member 62, a tongue stopper 71 adapted to come in pressure contact with the side wall of the brake pad 65 due to its own elastic deformation is formed integrally with the holding member 33*f* by slotting a part of the latter in the shape of an opposing pair of C-shaped slots CT. At a time before the ribbon cassette 14*a* is fitted to the housing 1 of the image building apparatus, one end 71*a* of the tongue stopper 71 is caused to come in contact with the brake pad 65 whereby the cores 31 and 32 are inhibited from free rotation. When it is fitted to the housing 1 of the apparatus, the pin 66 (FIG. 9B) held on the printer frame 50 pushes the other end 71*b* of the stopper 71 and thereby the one end 71*a* of the latter is moved away from the brake pad 65. According to the second embodiment of the invention the same advantageous features are achieved as in the foregoing embodiment and therefore the ribbon cassette 14*a* can be constructed in the simple manner using the reduced number of parts and components. It should be noted that the brake pad 65 may be replaced with a number of locking teeth projected in the radial direction on the side wall of the flange 31A. It should of course be understood that the other core 32 is provided with the above-described rotation inhibiting mechanism 70 in the same manner.

Figure 14:
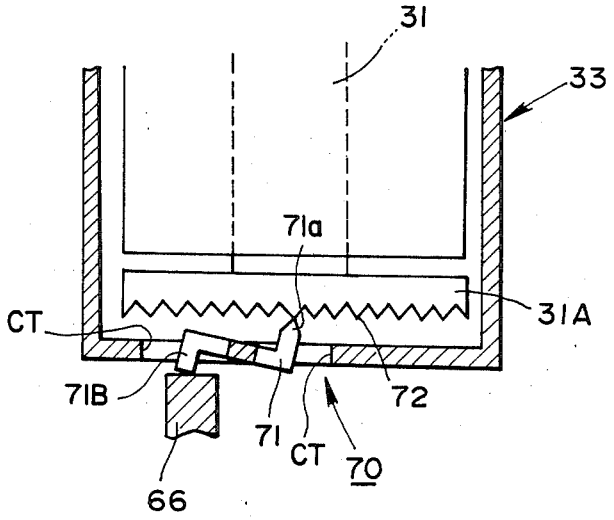
FIG. 14 is a fragmental cross-sectional view of the cassete in FIG. 13A, particularly illustrating how the core is inhibited from free rotation.

Next, description will be made below as to a ribbon cassette in accordance with the third embodiment of the invention with reference to FIGS. 13(A), 13(B) and 14.

Figure 13A:
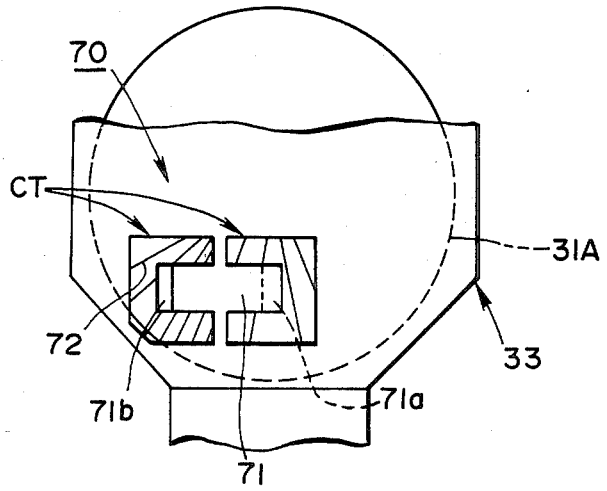
FIG. 13A is a fragmental side view of the cassette in accordance with the third embodiment of the invention.
Figure 13B:
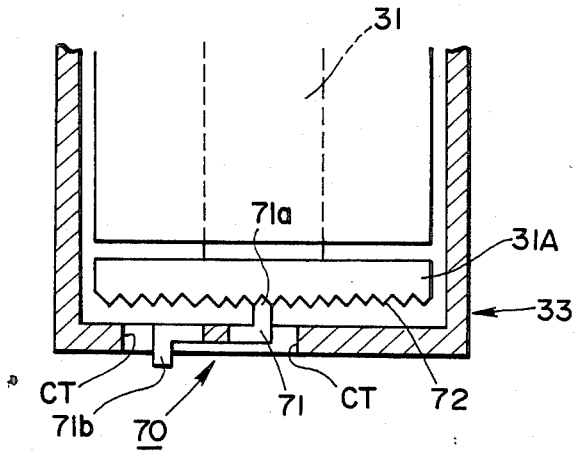
FIG. 13B is a fragmental cross-sectional view of the cassette in FIG. 13A.

FIG. 13A is a fragmental side view of the ribbon cassette in accordance with the third embodiment and FIG. 13B is a fragmental plan view of the same. The illustrated disposable ribbon cassette 14*a* is constructed such that the thermal transfer material cannot be replaced with another new one. A tongue stopper 71 is formed integrally with the case 33 on the side wall thereof in the same manner as in the foregoing embodiment. A number of locking teeth 72 are projected in the radial direction on the side wall of the flange 31A. At a time when the ribbon cassette 14*a* is fitted to the housing 1 of the image building apparatus, one end 71*a* of the stopper 71 is engaged with a locking tooth 72 as illustrated in FIG. 13B whereby the cores 31 and 32 are inhibited from free rotation. When it is fitted to the housing 1 of the apparatus, the pin 66 abuts against the other end 71*b* of the stopper 71 and thereby the one end 71*a* of the latter is disengaged from the locking tooth 72. Accordingly, the same advantageous features as those of the first and second embodiments are obtainable by employing the third embodiment as described above. Particularly, by designing the ribbon cassette 14*a* as a so-called disposable type it can be constructed in the simple manner with the use of the reduced number of parts and components.

Finally, description will be made as to a ribbon cassette 14*a* in accordance with the fourth embodiment of the invention with reference to FIGS. 15 to 18.

Figure 15:
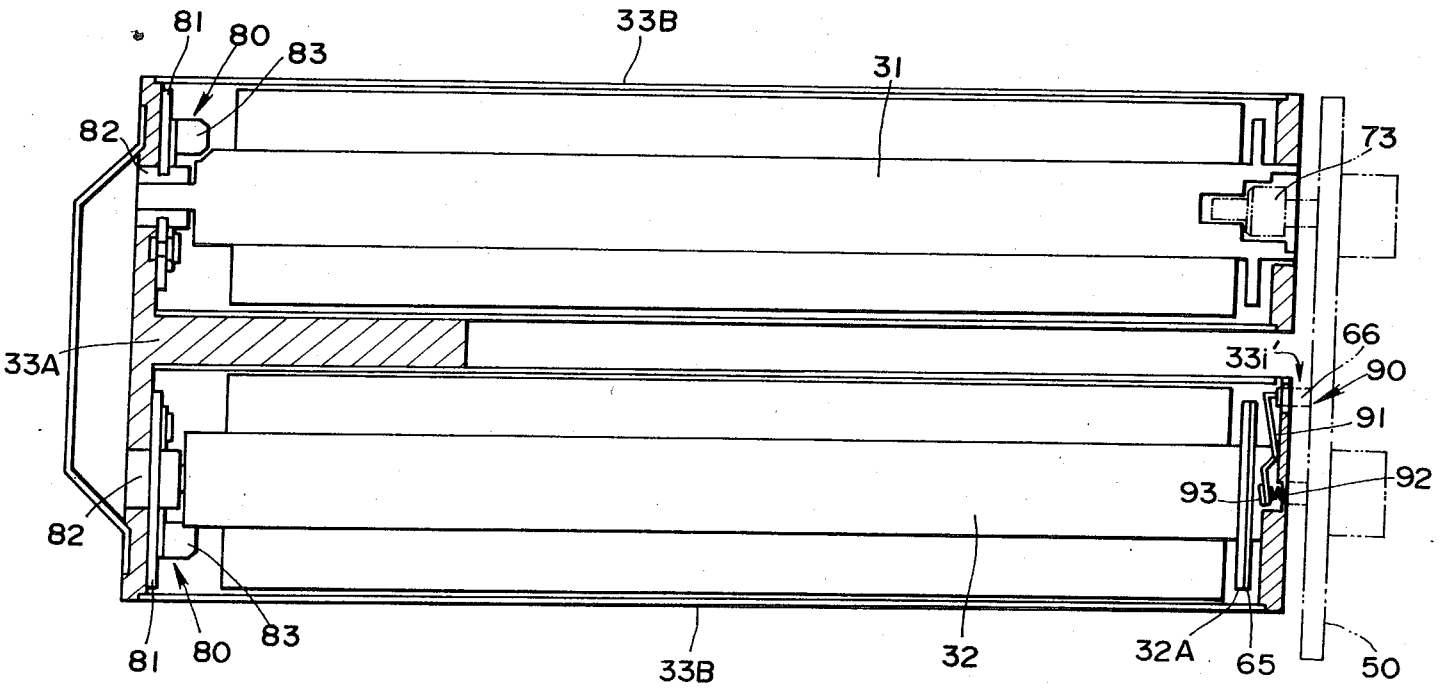
FIG. 15 is a front view partially in section of the cassette in accordance with the fourth embodiment of the invention.

FIG. 15 is a sectional front view of the ribbon cassette 14*a* in accordance with the fourth embodiment. The ribbon cassette 14*a* is illustrated in such an operative state that it has been fitted to the image building apparatus and the core 31 is ready to rotate by means of the coupling 73. At this moment the other core 32 is also ready to rotate by means of a similar coupling which is not shown in the drawing. The ribbon cassette 14*a* in accordance with the fourth embodiment is constructed in a different manner from that in accordance with the first to third embodiments, particularly in respect of rotational support mechanism 80 for the cores 31 and 32, and rotation inhibiting mechanism 90. It should be added that the core 31 is provided with a similar rotation inhibiting mechanism 90 which is not shown in the drawing.

Figure 16:
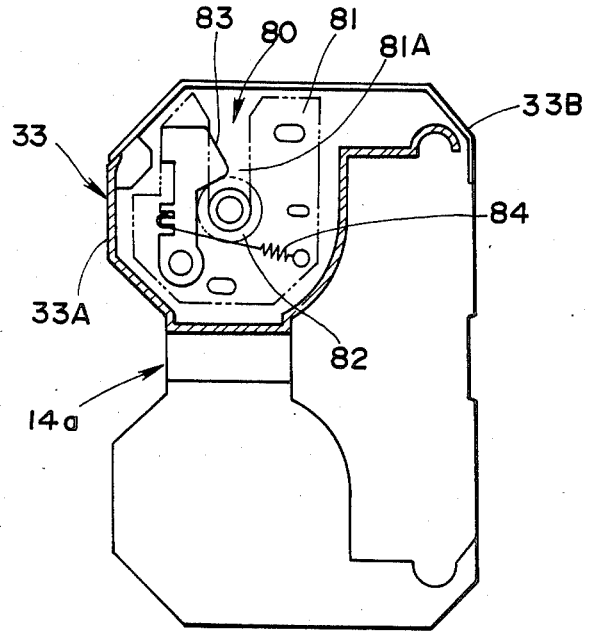
FIG. 16 is a partially exploded side view of the cassette in FIG. 14, particularly illustrating how the rotational support mechanism is constructed.

FIG. 16 is a fragmental sectional view of the ribbon cassette 14*a* illustrating the rotational support mechanism 80 in more detail. In the drawing reference numeral 81 designates a support frame fixedly secured to the case body 33A. The support frame 81 is formed with a vertically extending slit 81A in which a bushing 82 pivotally held on the one end of the cores 31 and 32 is received by a loose fitting. Further, the support frame 81 has a locking cam 83 turnably supported thereon. To assure that the free end of the locking cam 83 abuts against the outer surface of the bushing 82 to depress the latter so as to engage the bottom of the slit 81A, a resilient member 84 is spanned between the locking cam 83 and the support frame 81 whereby the locking cam 83 is caused to turn in the clockwise direction as seen in the drawing under the effect of resilient force of the resilient member 84.

Figure 17A:
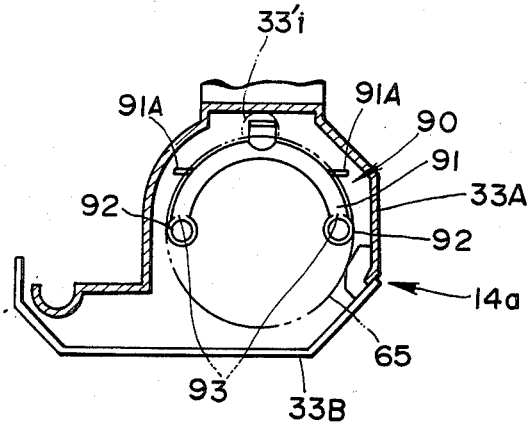
FIG. 17A is a fragmental side view of the cassette in FIG. 15, particularly illustrating how the rotation inhibiting mechanism is constructed.
Figure 17B:
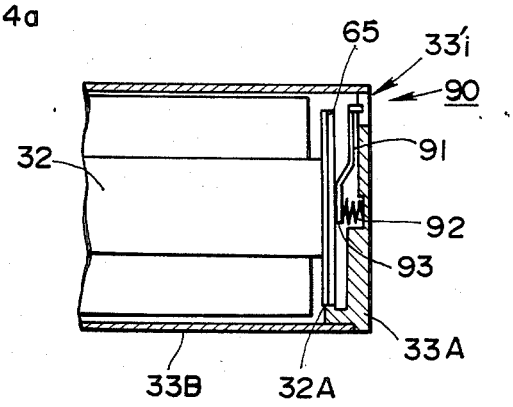
FIG. 17B is a fragmental cross-sectional view of the cassette in FIG. 17A, particularly illustrating how the frictional braking member comes in contact with the brake pad on the core.

FIG. 17(A) is a fragmental sectional side view of the ribbon cassette 14*a*, particularly illustrating the structure of the rotation inhibiting mechanism 90 in more detail, and FIG. 17B is a fragmental sectional front view of the same. In the illustrated embodiment the rotation inhibiting mechanism 90 is constituted by an arch-shaped stop lever 91 which is supported turnably about a support pin 91A fixedly secured to the inner wall of the case body 33A at the middle part thereof. Frictional braking members 93 are adhesively attached the inside surfaces of both the ends of the stop lever 91. Further, resilient members 92 such as compression coil springs or the like are interposed between the back sides of the frictional braking members 93 on the stop lever 91 and the inner wall of the case body 33A to normally bias the stop lever 91 toward the brake pad 65 under the effect of a resilient force of the resilient members 92. A release hole 33*i*′ is formed on the case body 33A so as to allow a part of the middle portion of the stop lever 91 to be exposed to the outside therethrough.

Figure 18:
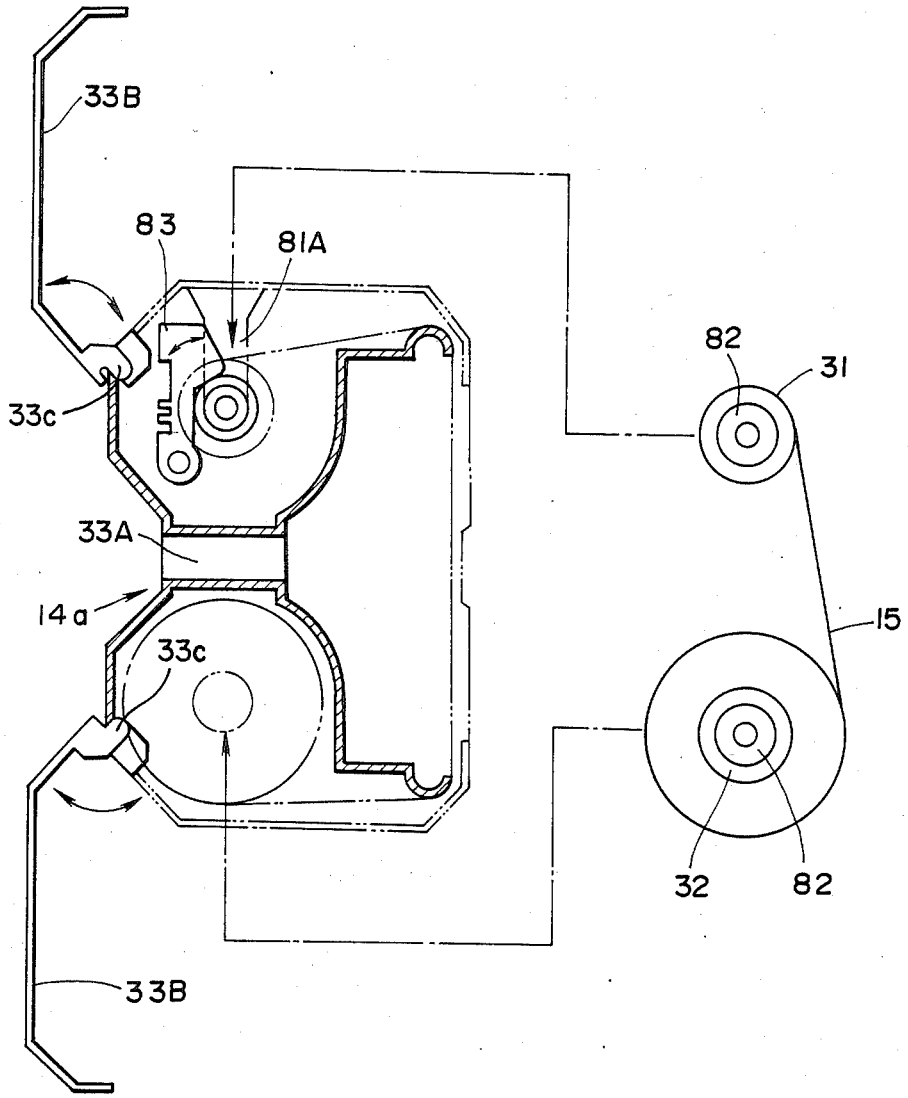
FIG. 18 is a schematic side view of the cassette in FIG. 15, particularly illustrating how both the cores are fitted to the case while the covers are kept opened away from the case body by turning movement about the upper end of the case.

As is best seen from FIG. 18, the cores 31 and 32 are fitted into the slits 81A (only the upper half is shown) and the bushings 82 are then rotatably held by means of the locking cams 83 (only the upper half is shown). After the cores 31 and 32 are fitted in the above-described manner, the frictional braking members 93 are brought in pressure contact with the braking pad 65 by turning movement of the stop lever 91 in the clockwise direction as seen in FIG. 17B under the effect of a resilient force of the resilient members 92 whereby the cores 31 and 32 are inhibited from free rotation. Thus, there is no fear of causing the thermal transfer material 15 to be loosened before the ribbon cassette 14*a* is fitted to the image building apparatus. When the ribbon cassette 14*a* is fitted to the image building apparatus, the pin 66 is inserted into the release hole 33*i*′ to engage the middle part of the stop lever 91, as illustrated in FIG. 15. As a result, the stop lever 91 is caused to turn about the support pin 91A in the counterclockwise direction against resilient force of the resilient members 92 and thereby the frictional braking members 93 are moved away from the brake pad 65. Incidentally, in the illustrated embodiment (see FIG. 18) each of the covers 33B is adapted to open by turning movement about hinge means 33*c*. However, the present invention should not be limited only to this. Any type of removing of the cover 33B from the case body 33A may be employed. Further, the rotational support mechanism 80 may be replaced with the holding member 33*f* which has been described above with reference to FIGS. 9A and 9B.

While the present invention has been described above with respect to a few typical embodiments thereof, it should of course be understood that it should not be limited only to them but various changes or modifications may be made in any acceptable manner without departure from the spirit and scope of the invention as defined by the appended claims. For instance, a stop lever or stopper may be directly brought into contact with the core without a frictional braking member or brake pad interposed therebetween in order to inhibit the core from being rotated freely.

As will be readily apparent from the above description, a characterizing feature of the present invention consists in a ribbon cassette of the type including a rotation inhibiting mechanism which is simple in structure and has smaller dimensions. For this reason the present invention can be readily applied either to a replaceable type or disposable type thermal transfer material holding cassette.

What is claimed is:

1. A transfer material holding cassette comprising:

a transfer material in a form of a ribbon having one surface coated with a properly selected coloring agent;

first and second cores for receiving and reciprocably displacing said transfer material, said first core winding said transfer material in a first direction and said second core unwinding said transfer material in a second direction opposite said first direction;

a case means for receiving said transfer material and said first and second cores, said case means detachably fittable to a housing of an image building apparatus together with said transfer material and said cores in which a required image is built by transferring coloring agent from said transfer material onto a material to be image transferred; and a first rotation inhibiting means disposed at a predetermined position corresponding to one of said first and second cores for inhibiting said one core from being rotated freely by exerting a force against said one core in a direction substantially parallel to a rotational axis of said one core at a time before the transfer material holding cassette is fitted to the housing of the image building apparatus and for releasing said one core from an inhibited state when said cassette is fitted to the housing.

2. A transfer material holding cassette as defined in claim 1, wherein said rotation inhibiting means comprises a lever pivotally supported on an inner wall of said case means and extending in a first plane at substantially a right angle relative to the rotational axis of said one core, a first end of said lever being located opposite to a second plane extending at a right angle relative to the rotational axis of said one core and a second end of said lever being located opposite to an opening formed on said case means; and a resilient member biasing said lever in such a direction that said first end of said lever comes in contact with said second plane under an effect of a resilient force in order to inhibit said one core from being rotated freely, said resilient member being released by turning said lever in an opposite direction by means of a pin which is inserted into the opening located opposite to said second end of said lever.

3. A transfer material holding cassette as defined in claim 2, wherein said rotation inhibiting means is mounted on a holding member constituting a part of said case means, said holding member being detachably fitted to said case means to rotatably hold one part of said one core.

4. A transfer material holding cassette as defined in claim 1, wherein said rotation inhibiting means comprises a tongue stopper which is formed integrally with the case means, and is located at a middle portion thereof, wherein a first end of said tongue stopper contacting a plane extending at a right angle relative to the rotational axis of said one core by elastic deforming of said tongue stopper, said one core being inhibited from being rotated freely and a second end of said tongue stopper being kept opened, so that said first end of said tongue stopper is released from a rotation inhibited state by thrusting said second end of said tongue stopper by means of a pin which is provided on the housing of the apparatus.

5. A transfer material holding cassette as defined in claim 4, wherein a plane of said one core contacting said tongue stopper is integrally formed with a number of locking teeth extending from the rotational axis of said first core in a radial direction.

6. A transfer material holding cassette comprising:

a first core means for winding transfer material in a first direction;

a second core means for winding said transfer material in a second direction, said first and second core means cooperating so as to reciprocably wind said transfer material;

a housing means, having an aperture, for detachably securing the cassette to a receiving apparatus; and a first rotation inhibiting means attached to said housing means comprising:

a support means;

a lever pivotally mounted at a middle portion of said support means, a first end of said lever extending substantially perpendicular to an axis of rotation of said first core means and a second end of said lever extending across said aperture, wherein an inward force against said second end causes a outward displacement of said first end; and means for normally biasing said first end of said lever against said first core means so as to exert a force against said first core means substantially parallel to the axis of rotation of said first core means;

whereby rotation of said first core means is inhibited by the force exerted against said first core means and whereby rotation is enabled by overcoming the normal bias via an inward force exerted via said aperture to said second end of said lever.

7. The transfer material holding cassette of claim 6, wherein an axial length of each of said core means is greater than a diameter of each of said core means, respectively, when each core means is fully wound with said transfer material; and wherein said holding cassette is receivable by the receiving apparatus in axial alignment with said cores means.

8. A transfer material holding cassette as defined in claim 7, wherein, said rotation inhibiting means is mounted on a holding member which comprises said support means, said holding member constituting a part of a case means, said holding member being detachably fitted to said case means to rotatably hold one part of said first core means.

9. A transfer material holding cassette as defined in claim 6, wherein said lever is provided with a frictional braking member at said first end.

10. A transfer material holding cassette as defined in claim 6, wherein a plane of said first core means extending at a right angle relative to the axis of the said first core means is lined with a braking pad.

11. A transfer material holding cassette as defined in claim 6, wherein said first end of said lever is lined with a frictional braking member, and a plane of said first core means contacting said lever is lined with a brake pad.

12. A transfer material holding cassette comprising:

case means for detachably securing the cassette to a receiving apparatus;

a first core means disposed in said case means for winding transfer material in a first direction;

a second core means disposed in said case means for winding said transfer material in a second direction, said first and second core means cooperating so as to reciprocably wind said transfer material;

wherein said case means has a side surface substantially parallel to a radial plane of a first one of said core means, and wherein a first pair of mutually opposing C-shaped slots are cut into said side surface opposite to said first one of said core means so as to integrally form a pivotable tongue stopper in said side surface; and whereby a first end of said tongue stopper engages with a radial plane of said first one of said core means and imparts a force substantially parallel to a rotational axis of said first one of said core means so as to inhibit rotation of said first one of said core means.

13. The transfer material holding cassette of claim 12, wherein an axial length of each of said core means is greater than a diameter of each of said core means, respectively, when each of said core means is fully wound with said transfer material; and wherein the holding cassette is receivable by the receiving apparatus in axial alignment with each of said core means.

14. A transfer material holding cassette as defined in claim 12, wherein a plane of said first one of said core means which contacts said tongue stopper is lined with a braking pad.

* * * * *